United States Patent [19]

Vasilenko et al.

[11] 4,099,572

[45] Jul. 11, 1978

[54] VAPOR-GAS MIXTURE GENERATING INSTALLATION FOR EXTINGUISHING UNDERGROUND FIRES

[76] Inventors: Valentin Vasilievich Vasilenko, ulitsa Levitskogo, 23, kv. 2; Leonid Denisovich Vishnevsky, ulitsa Levitskogo, 27, kv. 8; Viktor Matveevich Zvenyachkin, ulitsa Polotskaya, 20, kv. 55; Anatoly Ivanovich Ivchenko, Komsomolsky prospekt, 27, kv. 33; Mikhail Vasilievich Kolyshenko, ulitsa Artema, 161, kv. 6, all of Donetsk; Evgeny Petrovich Fedorov, Federativny prospekt, 4, kv. 7, Moscow, all of U.S.S.R.

[21] Appl. No.: 684,470

[22] Filed: May 7, 1976

[51] Int. Cl.[2] ..... A62C 13/52

[52] U.S. Cl. ..... 169/12; 60/39.71; 239/127.3; 239/265.17; 169/64

[58] Field of Search ..... 169/12, 11, 64; 239/265.17, 127.1, 127.3; 60/39.71; 165/170

[56] References Cited

U.S. PATENT DOCUMENTS

| | | | |
|---|---|---|---|
| 2,548,087 | 4/1951 | Williams | 169/12 UX |
| 2,621,477 | 12/1952 | Powter et al. | 60/39.71 X |
| 2,635,426 | 4/1953 | Meschino | 60/39.71 |
| 3,024,606 | 3/1962 | Adams et al. | 60/39.71 X |
| 3,055,179 | 9/1962 | Lefebvre et al. | 60/39.71 X |
| 3,667,680 | 6/1972 | Weed | 239/265.17 |

*Primary Examiner*—Richard A. Bertsch
*Assistant Examiner*—Michael Mar
*Attorney, Agent, or Firm*—Lackenbach, Lilling & Siegel

[57] ABSTRACT

A combustion chamber of an installation before its narrow section is made as two concentric tubes with a common vertical wall portion, featuring passages for supply of fuel and air into an annular space between the tubes. This space is sealed off at the outlet and divided by longitudinal partitions into two-way ducts with openings in the inner tube at the bottom. Relatively short partitions are preferably mounted along a helical line normal to tube surfaces to reduce the fuel-air flow resistance, resulting in higher efficiency of the installation.

1 Claim, 4 Drawing Figures

VAPOR-GAS MIXTURE GENERATING INSTALLATION FOR EXTINGUISHING UNDERGROUND FIRES

This invention relates to installations designed to produce large amounts of inert gases and can be employed to extinguish fires and prevent explosions in mines and other enterprises of mining industry.

There is known an installation for generation of a vapor gas mixture to extinguish underground fires comprising a blower, a combustion chamber and a water supply device (cf. for example, the Authors Certificate No. 231,502, E215/00).

This known installation is deficient in that fuel combustion is ineffective therein. This can be attributed to the fact that fuel combustion is effected by means of injecting cold liquid fuel, eg. kerosene, into the air stream directly before the combustion zone of the combustion chamber.

Besides, the known installation is deficient in that the resistance of its combustion chamber is too great. This can be explained by the fact that, as the fuel-air mixture moves along two-way ducts, the mixture temperature grows continuously and its volume grows respectively. Since cross-sections of these two-way ducts are uniform throughout the entire length, the velocity of the gas (fuel-air) stream increases and, consequently, the flow resistance within these ducts also increases.

Added resistance of the two-way ducts of the combustion chamber results in less head of the vapor-gas mixture at the outlet of the installation, which reduces its efficiency and the mixture feed distance.

The present invention is intended to increase the efficiency of fuel combustion and provides an advanced installation for this purpose.

Another object of this invention is to provide an installation for generating vapor-gas mixture, wherein the combustion efficiency of a source liquid fuel is increased, while the overall dimensions of the installation are reduced.

Yet another object of the invention is to provide an installation for generating vapor-gas mixtures, which can operate more effectively in enclosed and underground spaces.

Still another object of the invention is to provide an installation for generating vapor-gas mixtures, wherein water consumption for combustion chamber cooling can be reduced, while specified power is maintained.

A further object of this invention is to provide a vapor-gas generating installation, wherein the resistance to the movement of a fuel-air stream is reduced and, consequently, the general efficiency of the installation is increased.

And, finally, an object of this invention is to provide a relatively cheap, reliable vapor-gas generating installation, which can be employed for extinguishing fires and blowing of spaces in mines, etc.

To attain these and other objects there is provided, according to this invention, a vapor-gas generating installation for extinguishing underground fires, comprising a blower, a combustion chamber having a restricted section directed along the gas flow from the engine output and fuel and water supply systems. This installation is characterized by a combustion chamber comprising two concentric tubes extending to its restricted section provided at the inlet with a common vertical wall portion with passages for supply of fuel and air into an annular space between the tubes, which is sealed off at the outlet by a wall and divided by longitudinal partitions located at the passage sides into two-way ducts with openings on the inner tube near the vertical wall portion, long partitions, extending from the vertical wall portion to the wall alternating with shorter ones adjoining the vertical wall portion only.

Such design permits higher efficiency of injected fuel combustion owing to the fact that the combustion zone is fed with the vapor-air mixture previously heated to an optimum temperature and composed of fuel vapor mixed with air.

In one of the embodiments of the invention, there is provided a vapor-gas mixture generating installation characterized by short partitions of two-way ducts arranged along a helical line normal to the surfaces of the tubes to reduce the flow resistance of the combustion chamber.

The above mentioned improvement is introduced to reduce the resistance of the combustion chamber to the fuel-air flow resulting in increased the head of the vapor-gas mixture and increased efficiency of the installation and fuel supply distance.

The invention will now be described in more detail with reference to specific embodiments thereof, taken in conjunction with the accompanying drawings, wherein.

An installation comprises a blower 1, a combustion chamber 2, a fuel supply system 3 and a water supply system 4.

Figure 2:
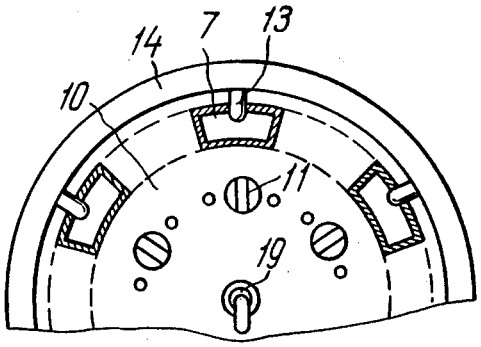
FIG. 2 shows a bottom view of the combustion chamber inlet side of the installation of FIG. 1.
Figure 3:
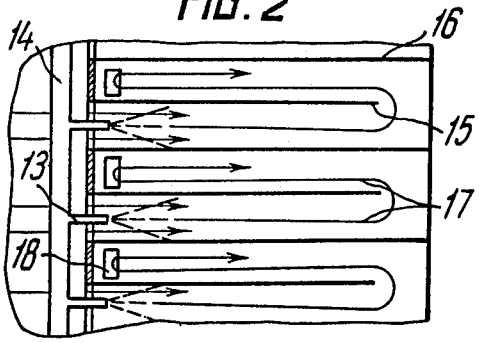
FIG. 3 shows an unfolded annular space between concentric tubes in the installation of FIG. 1.

The combustion chamber comprises two concentric tubes, an inner tube 5 and an outer tube 6 forming an annular space 7 therebetween, which is sealed off by the sealing wall 20 at the outlet, and a restricted section 8 with a water cooling jackets 9. A vertical wall portion 10 is positioned at the inlet of the chamber, provided with air pipes 11 having passages 12 opening into the annular space 7 and provided with nozzles 13 of a fuel manifold 14. Longitudinal short partitions 15 (FIGS. 2 and 3) and long (throughout the length of the annular space) partitions 16 are mounted at the passage sides, which divide the annular space 7 into two-way ducts 17. The inner tube is provided with openings 18 at the vertical wall portion 10.

An ignition device 19 is designed to ignite the fuel-air mixture.

The water supply system 4 serves to cool the narrow section of the combustion chamber and to cool and humidify the products of combustion.

The vapor-gas mixture generating installation for extinguishing underground fires operates as follows.

The air is supplied from the blower 1 to the bottom 10 of the combustion chamber and a part of this air passes through the pipes 11 to the inner tube 5, while another part passes through the passages 12 to the vertical wall portion 10 into two-way ducts 17. The same two-way ducts 17 are supplied with liquid fuel, e.g. kerosene, through the nozzles 13. The fuel evaporates there and mixes with air forming a vapor-air mixture. The vapor-air mixture is then heated up in the two-way ducts 17 to an optimum temperature and is supplied through the openings 18 into the inner tube to the vertical wall portion 10, where it is additionally turbulized by air streams flowing from the air pipes 11 and then fed to the combustion zone A, where it burns down.

Since the vapor-air mixture fed to the combustion zone is previously heated to an optimum temperature and consists of vaporized fuel mixed with air, the fuel burns more effectively than in the known installation (cf. Y. M. Pchelkin, Combustion Chambers of Gas-Turbine Engines, Mashinostroyenie, Moscow, 1967, pp. 102).

The products of combustion are cooled at the chamber outlet by water supplied by the water supply system 4. In cooling the gas flow, the water vaporizes and the vapor-gas mixture thus formed is directed along mines or delivery pipes to the fire area.

Figure 1:
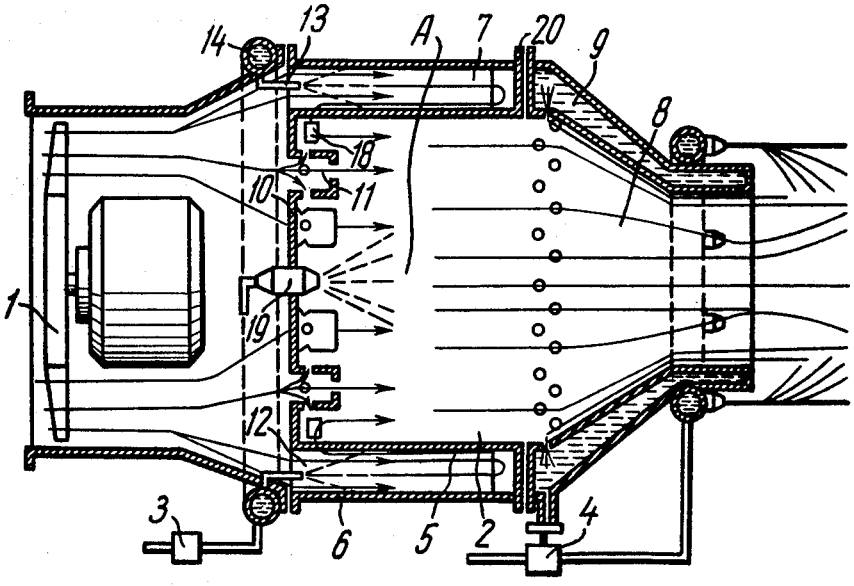
FIG. 1 shows a longitudinal section view of an installation, according to the invention.

In another embodiment of this invention a similar installation comprises a blower 1 (FIG. 1), a combustion chamber 2, a system of fuel supply 3 and a water supply system 4.

Figure 4:
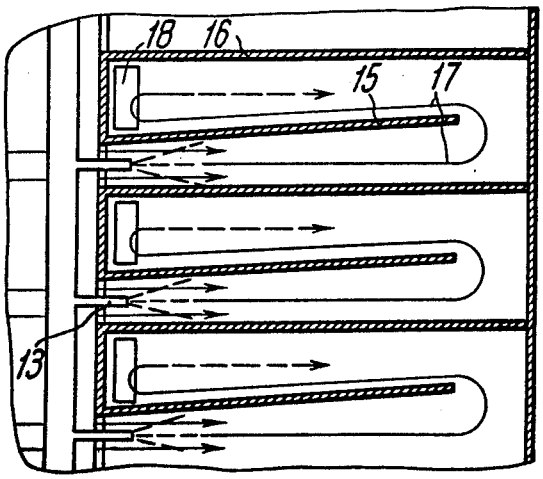
FIG. 4 shows an unfolded annular space between the tubes in the installation, according to another embodiment of the invention.

The combustion chamber comprises two concentric tubes, an inner tube 5 and an outer tube 6 forming an annular space closed at the outlet by a sealing wall 20, a vertical wall portion 10 and a restricted section 8. The vertical wall portion 10 is provided with air pipes 11 and passages 12, wherein nozzles 13 are placed to inject fuel to an annular space 7. Long partitions 16 (FIG. 4) and short partitions 15 are mounted in the annular space 7. The long partitions 16 are longitudinal and set radially to the surfaces of the tubes 5 and 6, whereas short partitions 15 are arranged along a helical line normal to the same surfaces of the tubes 5 and 6. The partitions, tubes, the vertical wall portion and sealing and walls form two-way ducts 17. Openings 18 are made in the inner tube 5 at the vertical wall portion (at the end of ducts), the openings being matched with two-way ducts 17.

Owing to the fact that the short partitions 15 are arranged along a helical line, the two-way ducts 17 are widening proportional to the increase of the fuel-air mixture temperature.

The products of combustion are cooled at the chamber outlet by water supplied by the system 4. In cooling the gas flow the water vaporizes and the vapor-gas mixture thus formed is delivered to the fire area.

What is claimed is:

1. A vapor-gas mixture generating installation for extinguishing fires, comprising a blower, a combustion chamber having a restricted section in the direction of gas flow leaving an engine, a fuel system, and a water supply system to cool the restricted section of the combustion chamber and to cool and humidify the combustion products, said combustion chamber before its restricted portion comprising two concentric tubes provided at the outlet with a common vertical wall portion with passages for fuel and air supply into an annular space between the tubes, which is sealed off by a wall at the outlet and divided by longitudinal partitions located at the passage sides into two-way ducts with openings on the inner tube near the vertical wall portion, long partitions extending from the vertical wall portion to the sealing wall, alternating with shorter partitions adjoining the vertical wall portion only, wherein said short partitions are arranged along a helical line normal to the tube surfaces.

* * * * *